US007344211B2

(12) United States Patent
Gomoll

(10) Patent No.: US 7,344,211 B2
(45) Date of Patent: Mar. 18, 2008

(54) DOOR-CLOSING DEVICE

(75) Inventor: Günter Gomoll, Elchingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/916,130

(22) Filed: Aug. 11, 2004

(65) Prior Publication Data

US 2005/0005397 A1 Jan. 13, 2005

Related U.S. Application Data

(63) Continuation of application No. PCT/EP03/00976, filed on Jan. 31, 2003.

(51) Int. Cl.
*E05F 5/02* (2006.01)

(52) U.S. Cl. ..... 312/405; 16/292; 49/386

(58) Field of Classification Search ..... 16/291, 16/292, 65; 49/386, 394, 192, 193; 292/DIG. 17, 292/DIG. 71; 312/405
See application file for complete search history.

(56) References Cited

U.S. PATENT DOCUMENTS 354,087 A * 12/1886 Becker ..... 16/65
1,307,948 A * 6/1919 Woodworth ..... 16/65
1,824,209 A * 9/1931 Jacobs ..... 126/191
2,016,519 A * 10/1935 Schmidt ..... 292/78
2,028,424 A * 1/1936 Van Dillen ..... 292/78
2,606,772 A * 8/1952 Mead et al. ..... 280/853
2,728,596 A * 12/1955 Curtiss, Jr. et al. ..... 292/332
2,777,722 A * 1/1957 Burke ..... 292/332
3,506,292 A * 4/1970 Hagendoorn et al. ..... 292/78
4,115,954 A * 9/1978 Larkin et al. ..... 49/240
4,947,583 A * 8/1990 Inui et al. ..... 49/193

FOREIGN PATENT DOCUMENTS

DE 243625 4/1911
FR 2.224.001 10/1974

* cited by examiner

*Primary Examiner*—Gregory J. Strimbu
(74) *Attorney, Agent, or Firm*—Russell W. Warnock; James E. Howard

(57) ABSTRACT

A self-closing door structure includes a frame, a door pivotally mounted on the frame, and an arm mounted on the frame and pivoting between two stop positions. A first stop position corresponds to a closed position of the door and the second stop position corresponds to an opened position of the door. Also included is a spring coupled to the arm and acting upon the arm in a direction towards the first stop position when the arm is located in a position between the first stop position and a dead center position of the spring. The arm has a driving element for coupling the motion of the door to that of the arm and is disposed for engaging with an engaging point of the door over the course of a closing motion of the door and for disengaging over the course of an opening motion of the door.

10 Claims, 3 Drawing Sheets

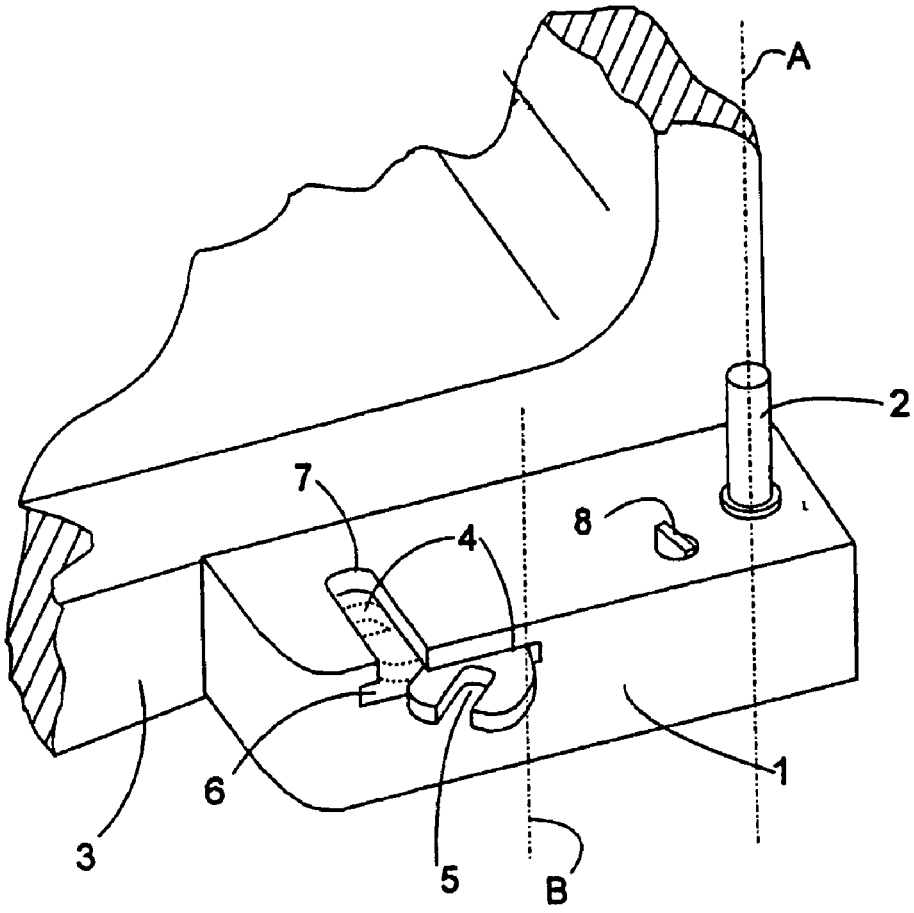
Fig.1
Fig. 2
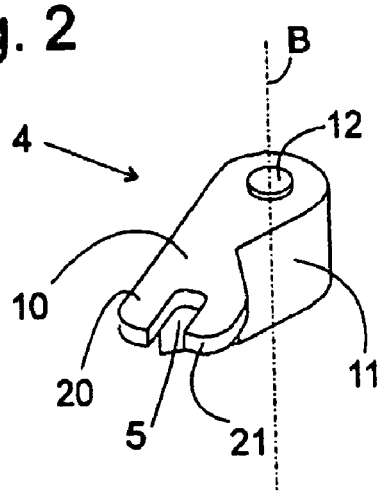
Fig. 3
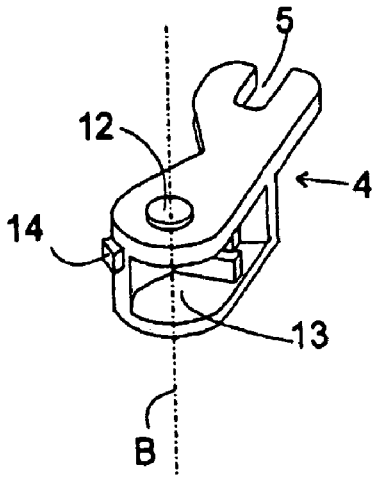

DOOR-CLOSING DEVICE

CROSS-REFERENCE TO RELATED APPLICATION

This application is a continuation, under 35 U.S.C. § 120, of copending international application No. PCT/EP03/00976, filed Jan. 31, 2003, which designated the United States; this application also claims the priority, under 35 U.S.C. § 119, of German patent application No. 102 05 590.4, filed Feb. 11, 2002; the prior applications are herewith incorporated by reference in their entirety.

BACKGROUND OF THE INVENTION

Field of the Invention

The present invention relates, in general terms, to a self-closing door structure. It relates, in particular, to a self-closing door structure for the door of a refrigerator.

The doors of refrigerators are usually equipped with a peripheral magnetic seal that exerts a magnetic force of attraction on a refrigerator frame located opposite the door. This force of attraction substantially results in the magnetic seal fitting closely against the frame, in the closed state of the door, over the entire length thereof. The magnetic force is adequate for the automatic closure of an incompletely closed door, at best, when the door is open by no more than a few millimeters.

Hinges with self-closing action are known for built-in refrigerators. Such hinges have two arms which are provided for fastening on the frame and the door of the refrigerator and can be pivoted in relation to one another between two stop positions, of which one corresponds to the closed position of the door and the other corresponds to an open position. A spring that is coupled to the pivoting movement of the arms is stressed to a maximum extent in a position between the two stop positions and forces the two arms, depending on the position in which they are located, in the direction of one of the two stop positions.

These hinges are heavy, bulky and costly. Moreover, they only allow two stable positions of the door: the closed stop position and the open stop position.

SUMMARY OF THE INVENTION

It is accordingly an object of the invention to provide a self-closing door structure that overcomes the hereinaforementioned disadvantages of the heretofore-known devices of this general type and that does not require any high-outlay hinges and/or that allows a continuous range of stable open positions for the door.

With the foregoing and other objects in view, there is provided, in accordance with the invention, a self-closing door structure, including a frame, a door pivotally connected to the frame between open and closed positions, the door having an engagement location and a pivoting movement including an opening movement and a closing movement, an arm pivotally connected to the frame between first and second stop positions, the first stop position corresponding to the closed position of the door and the second stop position corresponding to the open position of the door, the arm having pivoting movement and a carry-along element for coupling the pivoting movement of the door to the pivoting movement of the arm, the carry-along element engaging with the engagement location of the door during the closing movement of the door and disengaging therefrom during the opening movement of the door, and a bias device having dead-center position and being operatively coupled to the arm with respect to the pivoting movement of the arm, the bias device forcing the arm in a direction of the first stop position when the arm is disposed in a position between the first stop position and the dead-center position of the spring.

Because the arm, which can be pivoted under spring action, rather than being fixed to the door, merely interacts therewith through a carry-along element that can be engaged at an engagement location of the door and disengaged therefrom, the action of the spring-activated arm is restricted to those positions of the door where engagement is provided. The door can remain stable in all the open positions in which there is no engagement.

In accordance with another feature of the invention, the dead-center position of the spring is located between the first and second stop positions.

In accordance with a further feature of the invention, the carry-along element is, preferably, a cutout on the arm, which is open in the longitudinal direction of the arm, and the engagement location is a protrusion on the door. Although it would also be conceivable to construct the carry-along element as a protrusion and the engagement location as a cutout, the former solution can be realized with lower outlay.

In accordance with an added feature of the invention, the door and the arm can, preferably, be pivoted about different axes. It is, thus, possible for the engagement between the carry-along element and engagement location to be eliminated when the door is opened solely by the pivoting movement of the door and of the arm, without there being any need, for such a purpose, for an additional controlled movement of the arm or of the door with a further degree of freedom.

In accordance with an additional feature of the invention, the cutout of the arm is, preferably, bounded by two tongues. Of the tongues, one is located in the direction of the first stop position, which corresponds to the closed state of the door, and the other is located in the direction of the second stop position. The tongue that is located in the direction of the second stop position is the shorter of the two. This makes it possible for the protrusion, when it begins to engage in the cutout as the door closes, to pass the second tongue and to press against the first tongue to displace the arm in the direction of the first stop position. If the arm has reached the dead-center position, then the protrusion has, thus, penetrated some way into the cutout. When, once the dead center has been passed, the spring forces the arm in the direction of the first stop position, the second tongue presses against the protrusion and, thus, carries along the door in the direction of its closed position.

In accordance with yet another feature of the invention, door and the arm each have respective pivot axes and the pivot axis of the arm is disposed within a circle around the pivot axis of the door, the circle having a radius equal to a distance of the engagement location from the pivot axis of the door.

In accordance with yet a further feature of the invention, the carry-along element and the pivot axis of the arm define a first distance therebetween, the carry-along element and the pivot axis of the door define a second distance therebetween, and the first distance is shorter than the second distance.

In accordance with yet an added feature of the invention, the door structure is, expediently, also equipped with a catch for locking the arm in a releasable manner in the second position. This catch is important to prevent the arm from being displaced into the first stop position in any other way than by interaction with the protrusion. This is because, if it were possible, with the door wide open, for the arm to be displaced into the first stop position without the protrusion engaging in the cutout, then the arm, in its first stop position, would prevent the door from being completely closed. This is avoided by the catch.

In accordance with yet an additional feature of the invention, the catch can, expediently, be activated through an actuating element that is coupled to the position of the door. To be more precise, the catch blocks the pivoting movement of the arm as long as the door is wide open, and only releases the arm shortly before the protrusion begins to engage in the cutout of the arm.

In accordance with again another feature of the invention, the actuating element is, preferably, located closer to the pivot axis of the door than is the engagement location. The actuating element, thus, comes into contact with the door, as the latter closes, before the protrusion reaches the cutout, and it is actuated in good time by the contact with the door.

In accordance with again a further feature of the invention, there is provided a catch operatively connected to the frame and releasably locking the arm in the second stop position.

In accordance with again an added feature of the invention, the catch has actuating element activating the catch dependent upon a position of the door.

In accordance with again an additional feature of the invention, the door and the arm have pivot axes, the door has a narrow side, and the actuating element is displaced parallel to the pivot axes by the narrow side of the door.

In accordance with still another feature of the invention, the bias device is a spring.

With the objects of the invention in view, in a refrigerator having a frame, there is also provided a self-closing door structure, including a housing portion connected to the frame, a door pivotally connected to the housing portion between open and closed positions, the door having an engagement location and a pivoting movement including an opening movement and a closing movement, an arm pivotally connected to the housing portion between first and second stop positions, the first stop position corresponding to the closed position of the door and the second stop position corresponding to the open position of the door, the arm having pivoting movement and a carry-along element for coupling the pivoting movement of the door to the pivoting movement of the arm, the carry-along element engaging with the engagement location of the door during the closing movement of the door and disengaging therefrom during the opening movement of the door, and a bias device having dead-center position and being operatively coupled to the arm with respect to the pivoting movement of the arm, the bias device forcing the arm in a direction of the first stop position when the arm is disposed in a position between the first stop position and the dead-center position of the spring.

Other features that are considered as characteristic for the invention are set forth in the appended claims.

Although the invention is illustrated and described herein as embodied in a door-closing device, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

FIG. 1 is a fragmentary, perspective view of a corner of a housing of a refrigerator with a door structure according to the invention;

FIG. 2 is a perspective view of a pivoting arm of the door structure of FIG. 1 in a first orientation;

FIG. 3 is perspective view of a pivoting arm of the door structure of FIG. 1 in a second orientation;

DESCRIPTION OF THE PREFERRED EMBODIMENTS

Figure 4:
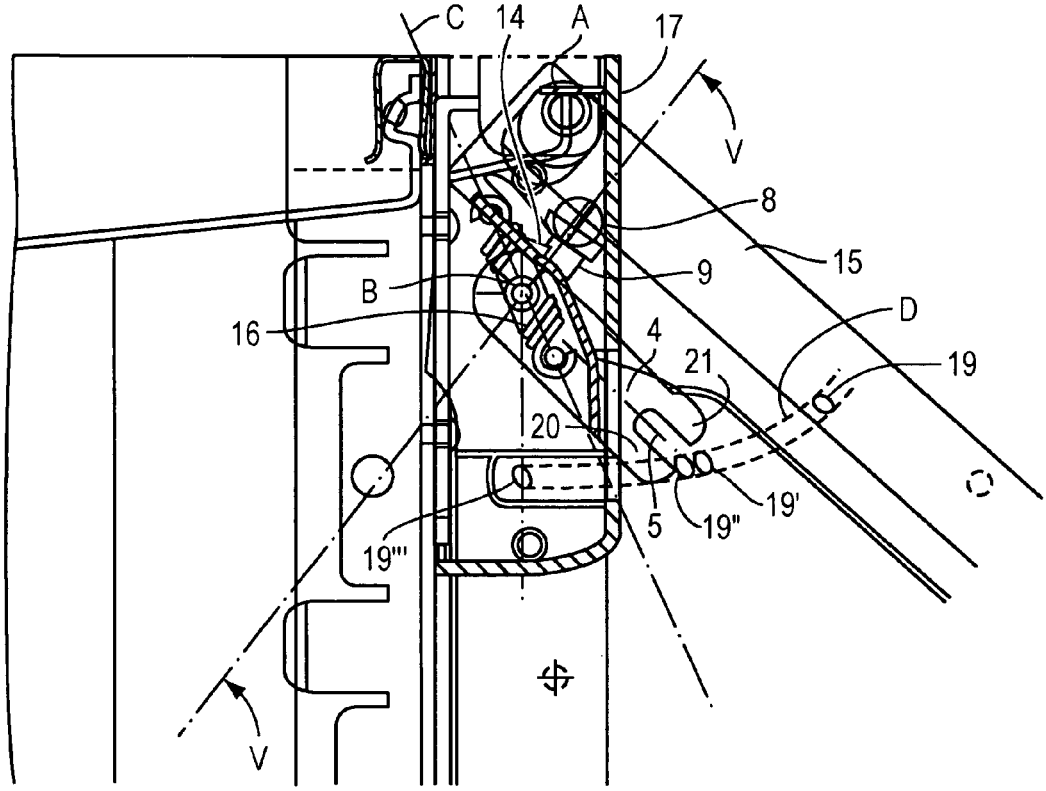
FIG. 4 is a horizontal cross-sectional view through the articulation housing of FIG. 1 with the door wide open.

Referring now to the figures of the drawings in detail and first, particularly to FIG. 1 thereof, there is shown a perspective view of a bottom front corner of a refrigerator housing, the corner being equipped with an articulation on which a door can be suspended. For the sake of clarity, the door 15, itself, is shown in FIG. 4, for example.

An articulation housing 1 is installed at a bottom corner of the frame 3 of the refrigerator and conceals a link plate that is screwed or riveted to the frame 3 and, for its part, bears an articulation pin 2 that projects upwards out of the articulation housing 1. The articulation pin 2 defines the pivot axis of the door, illustrated as chain-dotted line A.

An arm 4 is mounted in the articulation housing 1 such that it can be pivoted between an inner stop position and an outer stop position. In the figure, solid lines are used to illustrate the arm 4 in the outer stop position. In this position, a free end of the arm 4, with a cutout 5 formed therein, projects outward through a slot 6 on the front side of the articulation housing 1. In its inner stop position, the arm 4 is fully incorporated in the articulation housing 1; only part of the free end with the cutout 5, illustrated by dashed lines in the figure, remains visible through a slot 7 on the top side of the articulation housing 1.

Between the slot 7 and the articulation pin 2, a sloping run-on surface 8 of a vertically displaceable catch projects through an opening of the articulation housing 1.

FIGS. 2 and 3 show the arm 4 in two different perspective views, in FIG. 2 in the perspective of FIG. 1 and from the opposite direction in FIG. 3, from the interior of the refrigerator. The arm 4 has two portions of different thicknesses; a portion 10 that forms the free end and a base portion 11. The free portion 10 is configured, in a manner similar to the mouth of a wrench, as a solid plate of a few millimeters in thickness. It includes two tongues 20, 21 disposed on both sides of the cutout 5, the tongue 21, which is directed away from the frame 3, being shorter than the tongue 20, which is directed toward the frame 3. The base portion 11 has a height that corresponds to the height of the interior of the articulation housing 1, and it bears, on its top side and underside, a respective round, flat stud 12, which engages in each case in a non-illustrated recess of the top and bottom walls of the articulation housing 1 and, thus, defines a pivot axis B of the arm 4.

As FIG. 3 shows, the base portion 11 is hollow and open on its rear side, which is directed toward the frame 3. The inner cavity 13 of the base portion 11 is provided to accommodate a tension spring 16, the function of which is yet to be explained. Integrally formed on an outer side of the base portion 11 is an arresting protrusion 14 that interacts with the catch, bearing the run-on slope 8, in a manner that is yet to be explained.

FIG. 4 shows a horizontal section through the articulation housing 1 and the surroundings thereof, an illustration also being given here, to clarify the functioning of the door structure, of the wide-open door 15, which is actually located outside the section plane.

Disposed on the bottom narrow side of the door 15 is a downwardly directed protrusion 19, which is illustrated in the FIG. 4, in its position corresponding to the open position shown for the door 15, as a solid-black lozenge. As the door closes, the protrusion moves over a circular path D. Intermediate positions of the protrusion during the closing movement and the position of the protrusion when the door has been closed are illustrated as outlines 19', 19" and 19'".

The arm 4 is located in its outer stop position, which is also shown in FIG. 1. A tension spring 16, which is fastened by one end on the arm 4 and by another end on the articulation housing 1, extends through the cavity 13 of the arm 4. The centerline C of the tension spring 16 is located, in the position of the arm 4 that is shown in FIG. 4, at a small distance to the left of the pivot axis B (located vertically on the plane of the FIG. 4).

The tension spring 16 thus presses the arm 4 with a small amount of force against the front wall 17 of the housing 1 and, as such, stabilizes the outer stop position of the arm 4.

The catch 9, which bears the run-on slope 8, is in contact with a side surface of the arresting protrusion 14 and, thus, blocks the arm 4 in its outer stop position.

Figure 5:
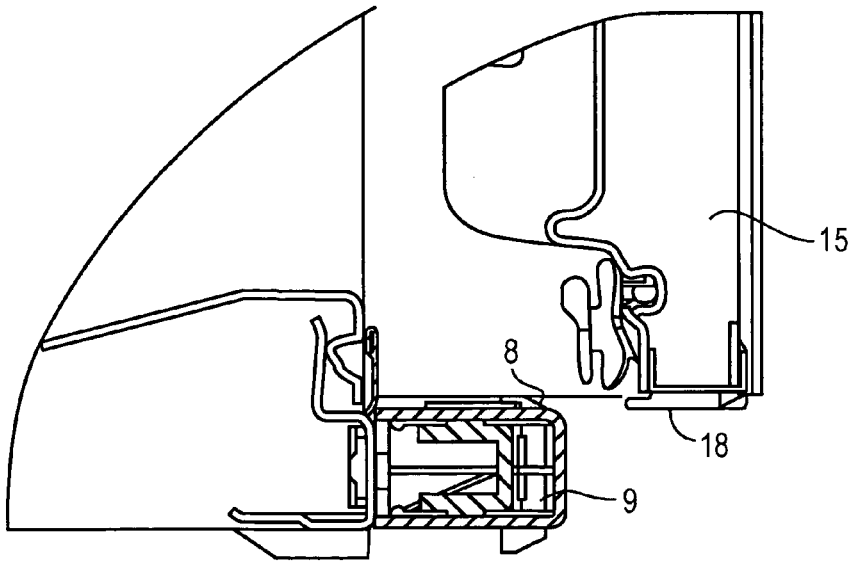
FIG. 5 is a vertical cross-sectional view through the articulation housing of FIG. 1 along section line V-V in FIG. 4.

As the vertical section of FIG. 5 shows, when the door 15 is open, the run-on slope 8 of the catch 9 projects beyond the bottom narrow side 18 of the door 15. As the door is closed, the run-on slope 8 comes into contact with the narrow side 18, with the result that the catch 9 is displaced downward and, thus, releases the arresting protrusion 14.

During or shortly after release, the protrusion reaches the position 19' in front of the tip of the shorter tongue 21. The protrusion passes the tongue 21 without striking against it, and, in the position designated 19" comes into contact with the longer tongue 20.

As the door closes further, the arm 4 follows the closing movement, driven by the protrusion 19 being in contact with the tongue 20. In such a case, the spring 16, in the first instance, counteracts the movement with a small amount of force. A dead center of the spring 16 is achieved when the centerline C of the spring 16 intersects the axis B.

Beyond the dead center, the spring 16 begins to force the arm 4 in the direction of its inner stop position. Because the distance of the cutout 5, or of the protrusion 19 engaging therein, from the axis B is smaller than the distance from the axis A, and the axis B is located within the circular path C, the protrusion 19 penetrates further and further into the cutout 5 during the closing movement of the door. As a result, when the dead center has been passed, the shorter tongue 21 strikes against the protrusion 19 and, thus, drives the closing movement of the door 15 until the door is completely closed.

Figure 6:
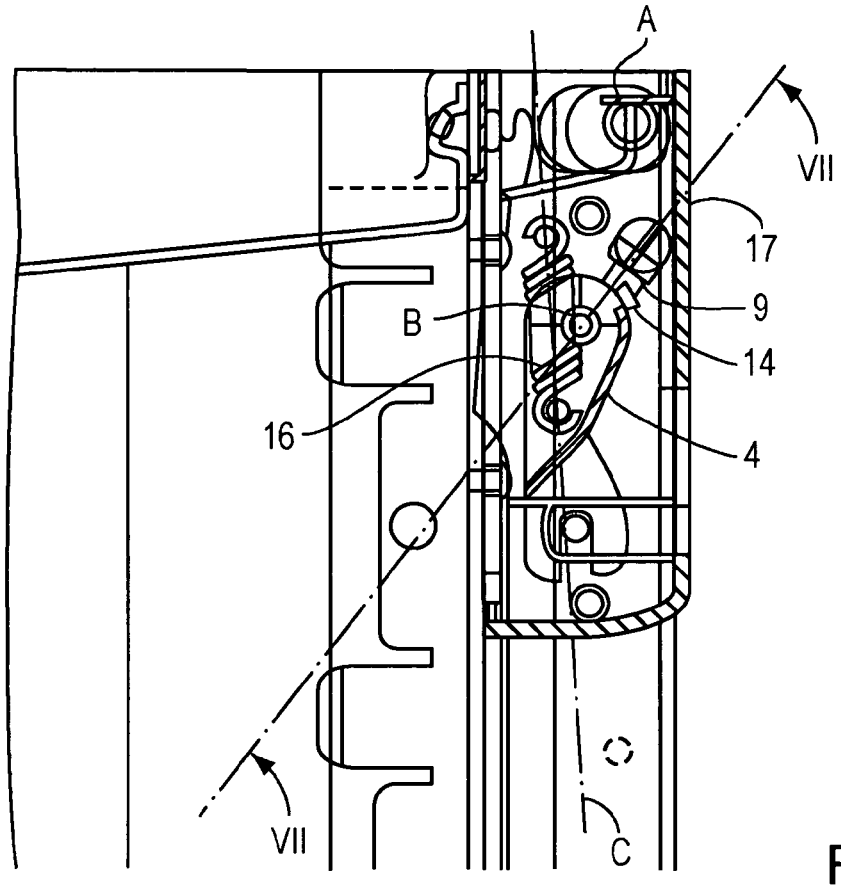
FIG. 6 is a horizontal cross-sectional view analogous to FIG. 4 with the door in a closed position.
Figure 7:
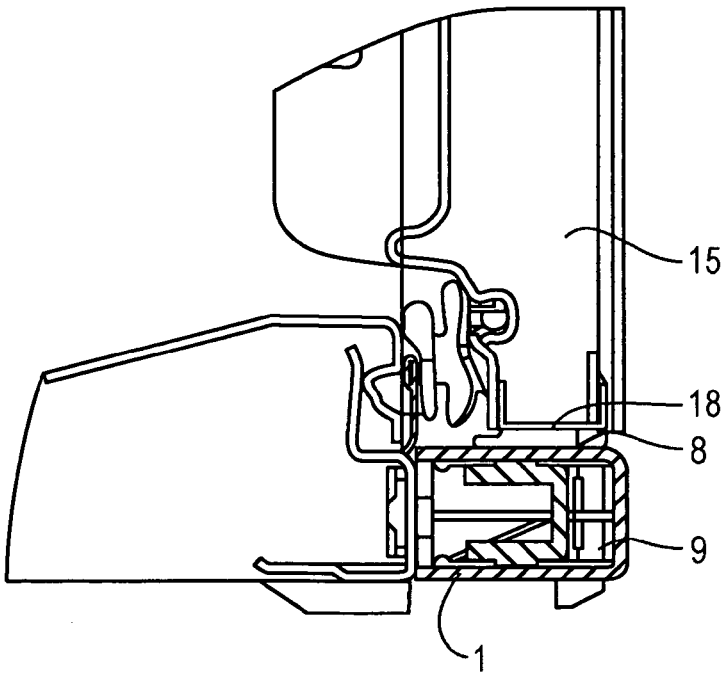
FIG. 7 is a vertical cross-sectional view analogous to FIG. 5 along section line VII-VII in FIG. 6 with the door in the closed position.

The closed state of the door 15 is shown in FIGS. 6 and 7, FIG. 7 being a section along line VII-VII from FIG. 6. The centerline C of the spring 16, here, runs more or less parallel to the front side of the frame 3, between this front side and the axis B of the arm 4. The arresting protrusion 14 of the arm 4 is located above the downwardly displaced catch 9. FIG. 7 shows the displacement of the catch 9 by way of contact with the bottom narrow side 18 of the door 15.

The length of the shorter tongue 21 is dimensioned such that, as the door opens, the protrusion 19 can only pass the tongue 21 when the dead center of the spring 16 has been reliably passed and the arm 4, under the force of the spring 16, reliably pivots into its outer stop position. When the outer stop position has been reached, the arresting protrusion 14 releases an upward movement of the catch 9, as a result of which the catch 9 blocks the arm 4 in its outer stop position until it is displaced again when the door 15 is closed again.

I claim:

1. A self-closing door structure, comprising:

a frame;

a door pivotally connected to said frame for pivotal movement with respect to said frame about a door pivot axis between open and closed positions, the door having a protrusion;

an arm pivotally connected to said frame for pivotal movement between first and second stop positions, said first stop position corresponding to said closed position of said door and said second stop position corresponding to said open position of said door, said arm having a cut-out portion engaging said protrusion of said door during a closing movement of said door and disengaging therefrom during said opening movement of an door;

a biasing device having a dead-center position and being physically and directly connected to said arm to force said arm towards said first stop position when said arm is disposed in a position between said first stop position and said dead-center position of said bias device; and a catch releasably locking said arm in said second stop position and having an actuating element, the catch moving in a direction substantially parallel to the door pivot axis to release said arm from said second stop position in response to the door engaging the actuating element.

2. The door structure according to claim 1, wherein the door includes a bottom side that engages the actuating element of the catch.

3. The door structure according to claim 1, wherein the actuating element of the catch includes a sloped-surface.

4. A refrigerator comprising:

a frame having a cooling chamber at least partially disposed within the frame;

a door pivotally supported for movement with respect to the frame about a door pivot axis between open and closed positions, the door having a protrusion;

an articulation housing fixedly connected to the frame and being disposed adjacent the door pivot axis, the housing including an adjacent wall facing toward the door when the door is in the closed position said adjacent wall defining a protrusion slot for receiving the protrusion said housing further including a front wall facing away from the frame and defining a front slot;

an arm pivotally connected to the articulation housing for pivotal movement about an arm pivot axis between an inner stop position and an outer stop position, the arm including a free end portion having a cut-out formed between two tongues said free end portion extending through the front slot when the arm is in the outer stop position, the arm being disposed within the housing when the arm is in the inner stop position, the inner stop position corresponding to the closed position of the door and the outer stop position corresponding to the open position of the door, the arm engaging the protrusion within the cut-out as the door is moved from the open position toward the closed position with the free end portion pivoting into the housing through the front slot and the protrusion being received within the protrusion slot; and a biasing device having a first end connected to a fixed mount being fixed with respect to the frame and a second end connected to an arm mount on the arm.

5. The refrigerator according to claim 4, wherein the front slot restricts movement of the arm.

6. The refrigerator according to claim 4, wherein the housing is disposed below the door and the adjacent wall faces upwardly toward the door when the door is in the closed position.

7. The refrigerator according to claim 4, further comprising a catch releasably locking the arm in the outer stop position said catch having an actuating element projecting through the adjacent wall which releases the arm in response to the door engaging the actuating element.

8. The refrigerator according to claim 7, wherein the actuating element of the catch includes a sloped-surface and the catch is movable in a direction substantially parallel to the door pivot axis in response to the door engaging the sloped-surface.

9. The refrigerator according to claim 4, wherein the arm moves from the inner stop position to the outer stop position and the protrusion is disengaged from the cut-out when the door is moved from the closed position into the open position.

10. The refrigerator according to claim 4, wherein the door includes a central axis extending vertically through the door and dividing the door into substantially equal halves, the protrusion being disposed between the door pivot axis and the central axis.

* * * * *